US006053149A

United States Patent [19]

Lorraine

[11] Patent Number: 6,053,149

[45] Date of Patent: Apr. 25, 2000

[54] FUEL INJECTOR CLIP RETENTION ARRANGEMENT

[75] Inventor: Jack R. Lorraine, Newport News, Va.

[73] Assignee: Siemens Automotive Corporation, Auburn Hills, Mich.

[21] Appl. No.: 09/086,085

[22] Filed: May 28, 1998

[51] Int. Cl.[7] ..... F02M 51/00; F02M 41/00

[52] U.S. Cl. ..... 123/470; 123/456

[58] Field of Search ..... 123/470, 456, 123/472, 468, 469

[56] References Cited

U.S. PATENT DOCUMENTS 5,035,224 7/1991 Hornby et al. ..... 123/470
5,136,999 8/1992 Bassler et al. ..... 123/470
5,301,647 4/1994 Lorraine ..... 123/470
5,501,195 3/1996 Hall ..... 123/470
5,803,052 9/1998 Lorraine et al. ..... 123/470
5,893,351 4/1999 Akutagawa et al. ..... 123/470

*Primary Examiner*—Henry C. Yuen
*Assistant Examiner*—Mahmoud M. Gimie

[57] ABSTRACT

A clip retention arrangement for a fuel injector inserted in a fuel rail seat, in which a U-shaped clip has tabs engaging an injector groove and also has slots captured on ears projecting from opposite sides of the socket. Each of the ears are configured to engage their associated slot to restrain relative rotation and to assist in properly orienting the fuel injector in the seat.

6 Claims, 2 Drawing Sheets

FUEL INJECTOR CLIP RETENTION ARRANGEMENT

BACKGROUND OF THE INVENTION

This invention concerns engine fuel injector installations and more particularly arrangements for retaining a fuel injector in position in a predetermined rotative orientation in a fuel rail injector seat.

Engine fuel injectors are generally cylindrical valve assemblies which are typically installed in seats formed in a fuel rail. The fuel rail is supplied with fuel under pressure, which is directed into the engine cylinders through the fuel injectors. Each fuel injector has a valve needle moved to open and close an orifice in a valve seat by operation of a solenoid coil energized by the engine electronic controls.

In manifold injection engine applications, the fuel injectors should preferably be in a particular rotative orientation in order to provide an optimal relationship of the fuel spray pattern with the associated intake valve.

It has heretofore been known to use clips to retain each fuel injector in its fuel rail injector seat so as to be able to resist the fuel pressure exerted on the injector, and at the same time hold the injector in the desired rotative orientation.

U.S. Pat. No. 5,136,999 issued on Aug. 11, 1992 for "Fuel Injection Device for Internal Combustion Engines" describes such an installation.

In one design, a U-shaped clip has slots which capture fuel rail projecting features to be axially locked thereto. This clip is also properly rotatively oriented by clip corners engaging fuel rail projections adjacent the injector seat. The clip in turn also has spaced legs formed with tabs formed with arcuate edges which are received in a fuel injector slot to axially lock the fuel injector in place. To rotatively orient the injector with respect to the clip, there is a flat on each tab edge which engages a flat surface on either side of the injector groove.

When installing the electrical connectors or working with the wiring harnesses, turning forces can be inadvertently applied to the fuel injectors tending to rotate them out of their correct orientation. The engagement between the injectors and clips typically is such that the clip legs tend to be spread apart by the turning forces. If excessive force is applied, the clip can be forced out of an injector body groove used as the axial locking feature, and also can be permanently deformed so at to no longer retain the injector properly.

In addition, the engagement features on the clip and fuel rail adjacent the injector seat also may tend to spread open the clip legs when the injector is turned. The net effect is to reduce the reliability of the arrangement for holding the installed fuel injectors in the proper rotative position.

Accordingly, it is an object of the present invention to provide an improved clip retention arrangement for fuel injectors which much more reliably functions to properly orient the fuel injector in a fuel injector seat.

SUMMARY OF THE INVENTION

The above recited object is achieved by providing fuel rail ear projections shaped on one side to engage one end of a respective clip slot into which the ear is received. When the fuel injector tends to be turned in either direction, one of the ear projections engages the end of its associated slot and resists further turning movement of the clip. The installer can much more readily sense when the injector is properly oriented, by the felt resistance to turning of the fuel injector out of its proper orientation, as well as by the observed position of the clip legs.

The spring steel clip also generates a significant restoring force tending to reorient the injector once the turning force is no longer exerted.

DESCRIPTION OF THE DRAWING FIGURES

DETAILED DESCRIPTION

Figure 1:
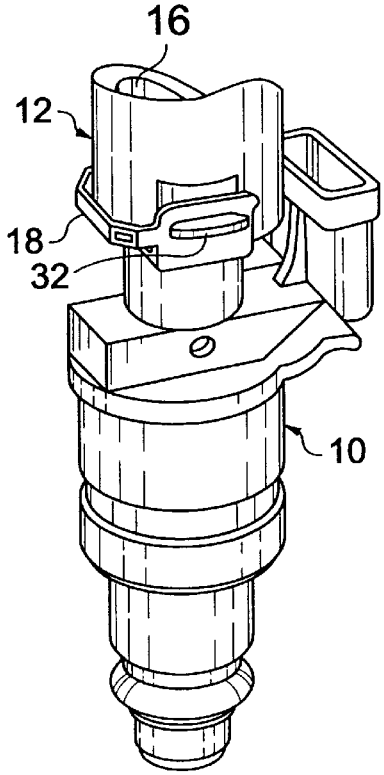
FIG. 1 is a perspective view of an installed fuel injector and fragmentary portions of the fuel rail injector seat.
Figure 2:
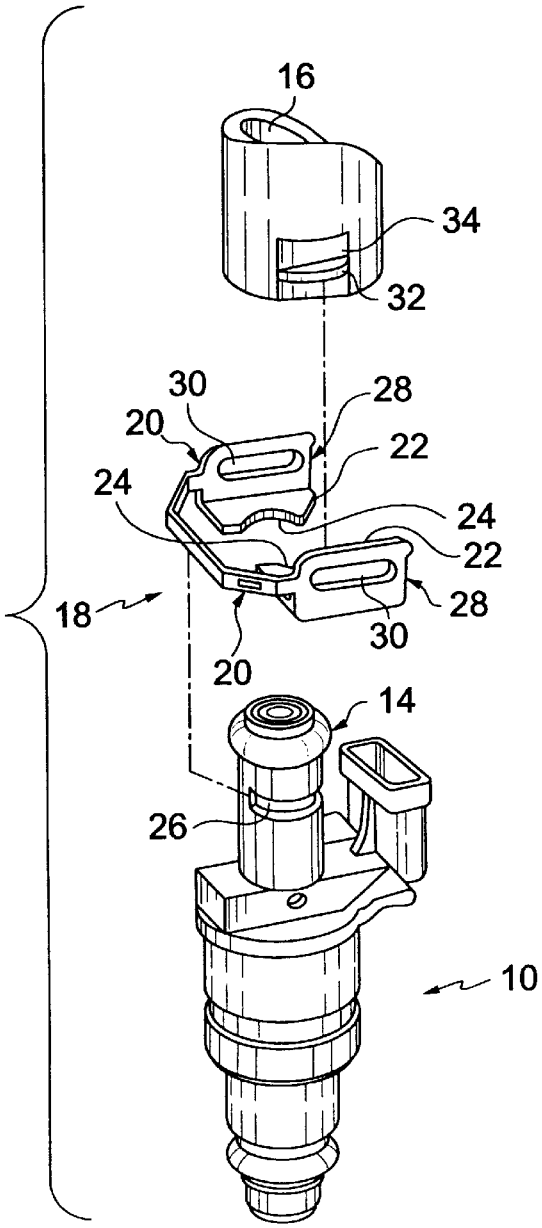
FIG. 2 is a fragmentary view of the mating end of an installed fuel injector showing the locking slot engagement of the retention clip.

Referring to the drawings, and particularly FIGS. 1 and 2, a fuel injector 10 is shown installed in seat 12 forming a part of a fuel rail. The upper end 14 of the fuel injector 10 is received in a bore 16 of the seat 12, and retained with a U-shaped spring steel clip 18. The clip 18 has a pair of legs 20 formed with inwardly extending flat tabs 22 having arcuate cutouts 24 received into a groove 26 in the fuel injector upper end 14 to engage and axially retain the fuel injector 10.

The clip legs 20 are also formed with vertical sides 28 angled outwardly at the top, and each having a horizontal slot 30.

When the fuel injector 10 with the clip 18 installed is advanced into the bore 16, the clip legs 20 are spread apart by the angled sides 28 to clear a pair of retention ears 32 integrally formed to project radially from opposite sides of the fuel rail seat 12. The clip legs 20 snap back over the ears 32 when the slots 30 move up into alignment with the ears 32.

Figure 3:
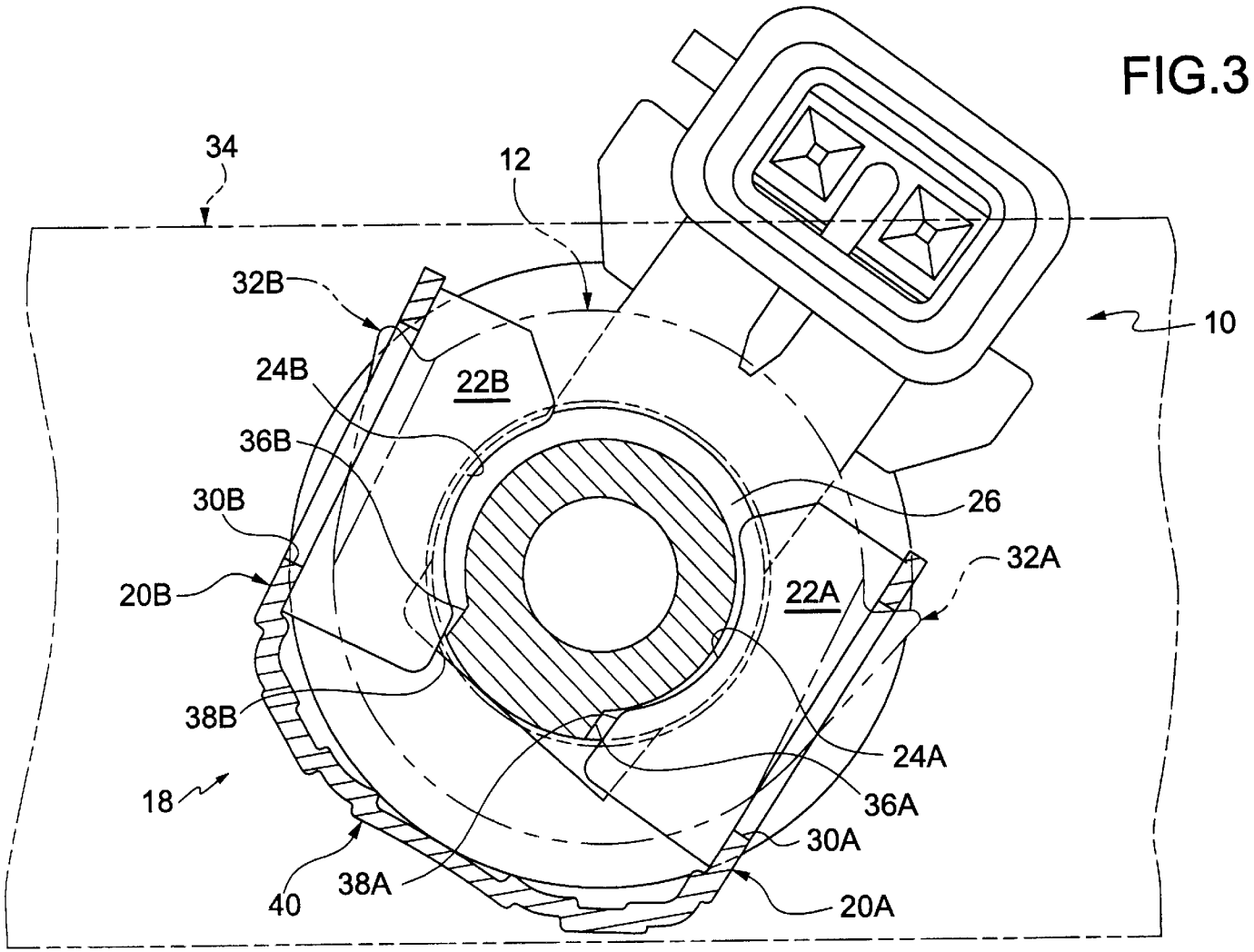
FIG. 3 is an enlarged plan view of a retention clip fuel rail seat and injector showing the injector slightly turned to engage the clip and seat features.

Referring to FIG. 3, the fuel rail 34 is shown, from which the injector seat 12 extends. The fuel injector groove 26 does not extend completely around the perimeter of the injector body, leaving a solid area on one side defining two flats 36, which are opposite two straight edges 38A, 38B on the flat tabs 22A, 22B of the clip 18. The straight edges 38A, 38B are on the side of the arcuate features 24 closer to the leg joining section 40 of the clip 18.

The ears 32A, 32B are shaped (slightly hooked) so as to engage one end of the slot 30A through which it protrudes when the injector 10 is attempted to be rotated past a certain point. This engagement prevents the clip 18 from being rotated with the injector 10, and also restrains the associated clip leg 20A from being deflected outwardly.

This creates a well defined resistance to further rotation of the fuel injector 10 to be easily felt by an installer, and also tending to generate a force tending to maintain the rotative orientation of clip 18 on the injector seat 12.

The movement of the opposite deflected leg 20B is amplified to be quite visible such as to also provide a visual cue that the injector 10 is being rotated out of its proper orientation.

The leg 20B may also give an audible click when the injector 10 is rotated back as a further aid.

The spring force developed as leg 20B is deflected by the engagement of the injector flat 36B tends to restore the injector 10 to its proper orientation.

I claim:

1. A retention arrangement for retaining a fuel injector in a bore of a fuel rail injector seat, comprising:

a fuel rail injector seat having a pair of outwardly projecting ears;

a fuel injector having an outer surface, a solid area located on the outer surface, the solid area having a first face and a second face, a groove disposed on the outer surface between the first face and the second face;

a substantially U-shaped spring clip having a pair of legs connected by a continuous member, the legs straddling the seat and the fuel injector, each leg having a tab and a slot, the tab including an arcuate edge and a straight edge, the arcuate edge being received in the groove to maintain the clip in a fixed axial position relative to the fuel injector, and the straight edge engaging a respective face of the first face and the second face of the solid area to inhibit relative rotation of the fuel injector and to the clip, the slot of the leg receiving a respective ear of the pair of ears to axially secure the clip to the seat, each slot having an end that engages the respective ear to inhibit relative rotation of the clip and the seat.

2. The arrangement of claim 1, wherein each of the ears angle outwardly from the seat along their length, each ear having a first end flush with the seat and a second end offset a distance from the seat, the second end having a rounded hook that receives the respective slot end.

3. An arrangement for retaining a fuel injector in a bore of a fuel rail injector seat, comprising:

a fuel rail injector seat having a pair of outwardly projecting ears, each of the ears having a first end flush with the seat and a second end offset a distance from the seat, the second end being a rounded hook;

a fuel injector having a groove in an outer surface thereof;

a substantially U-shaped spring clip having a pair of legs straddling the seat and the fuel injector, each leg having a tab and a slot, the tab including an arcuate edge being received in the groove of the fuel injector to maintain the clip in a fixed axial position relative to the fuel injector, the slot receiving a respective ear to axially secure the clip to the seat, each slot having an end that engages a respective second end to inhibit relative rotation of the clip and the seat.

4. The arrangement of claim 3, wherein the fuel injector comprises a solid area having a first face and a second face, the groove extending between the first face and the second face;

wherein the clip comprises a continuous member connecting each of the pair of legs; and wherein each tab comprises a straight edge adjacent to the arcuate edge, the straight edge engaging a respective face of the first face and the second face to inhibit relative rotation of the fuel injector and the clip.

5. A fuel rail injector seat, comprising:

a pair of outwardly projecting ears, each ear angling outwardly from the seat along their length so that a first end is flush with the seat and a second end is offset a distance from the seat, the second end being formed as a rounded hook.

6. The fuel rail injector seat of claim 5, in combination with:

a fuel injector having a groove;

a substantially U-shaped spring clip having a pair of legs straddling the seat and the fuel injector, each leg having a tab and a slot, the tab including an arcuate edge being received in the groove to maintain the clip in a fixed axial position relative to said fuel injector, the slot receiving a respective ear of the pair of ears to axially secure the clip to the seat, each slot having an end that engages a respective second ear end to restrain relative rotation of the clip and the seat.

* * * * *